US005306701A

United States Patent [19]

Israelsson et al.

[11] Patent Number: 5,306,701

[45] Date of Patent: Apr. 26, 1994

[54] SUPERCONDUCTING MAGNET AND FABRICATION METHOD

[75] Inventors: Ulf E. Israelsson, Monrovia; Donald M. Strayer, Altadena, both of Calif.

[73] Assignee: California Institute of Technology, Pasadena, Calif.

[21] Appl. No.: 662,266

[22] Filed: Feb. 28, 1991

[51] Int. Cl.[5] ..... H01F 7/22

[52] U.S. Cl. ..... 505/213; 29/599; 335/216; 335/284

[58] Field of Search ..... 505/1, 879, 924; 29/599; 335/216, 284, 296-301

[56] References Cited

U.S. PATENT DOCUMENTS

| | | | |
|---|---|---|---|
| 4,190,817 | 2/1980 | Rabinowitz | 335/216 |
| 4,722,134 | 2/1988 | Wilson | 29/599 |
| 4,904,971 | 2/1990 | Jin | 335/216 |
| 5,041,419 | 8/1991 | Leupold | 505/1 |
| 5,113,163 | 5/1992 | Leupold | 335/216 |

FOREIGN PATENT DOCUMENTS

| | | | |
|---|---|---|---|
| 0255904 | 10/1988 | Japan | 335/216 |
| 0116906 | 5/1991 | Japan | 335/216 |

*Primary Examiner*—Leo P. Picard
*Assistant Examiner*—Raymond Barrera
*Attorney, Agent, or Firm*—Loyal M. Hanson

[57] ABSTRACT

A method of trapping a field in a block of superconductor material, includes providing (i) a block of material defining a bore, (ii) a high permeability core within the bore that defines a low reluctance path through the bore, (iii) a high permeability external structure on the exterior of the block of material that defines a low reluctance path between opposite ends of the core, and (iv) an electromagnet configured to apply a magnetic field around the high permeability core. The method proceeds by energizing the electromagnet to produce an applied magnetic field around the high permeability core, cooling the block of material sufficiently to render the block of material superconducting, de-energizing the electromagnet to result in a trapped magnetic field, and at least partially removing the low reluctance path defined by the core and the external structure in order to increase the magnetic flux density of the trapped magnetic field.

6 Claims, 2 Drawing Sheets

SUPERCONDUCTING MAGNET AND FABRICATION METHOD

ORIGIN OF INVENTION

The invention described herein was made in the performance of work under a NASA contract, and is subject to the provisions of Public Law 96-517 (35 USC 202) in which the Contractor has elected to retain title.

BACKGROUND OF THE INVENTION

1. Technical Field

This invention relates generally to cryogenics, and more particularly to a superconducting magnet made from materials such as the copper-oxide superconducting materials that become superconductive at relatively high temperatures.

2. Background Information

Some known materials exhibit superconductivity when cooled with liquid helium to four degrees above absolute zero (four kelvins). Others, called high temperature superconductor (HTS) materials, become superconducting at higher temperatures and so they can be cooled with liquid nitrogen. Since liquid nitrogen is relatively abundant and inexpensive, such HTS materials promise substantial savings in cooling costs. Just as important, they can sustain the large current density needed for many superconductor-magnet applications currently proposed.

Consider, for example, the ceramic HTS material yttrium-barium-copper-oxide ($YBa_2Cu_3O_7$), sometimes referred to as a "1-2-3" superconductor. It has an anisotropic crystalline structure characterized by sheets formed of copper and oxygen in parallel a-b planes such that electric current flows best when channeled along the a-b planes and less easily in a perpendicular direction (i.e., the c-axis). Along the a-b planes, 1-2-3 can sustain a current density over 10,000 amperes per square centimeter ($10^4$ A/cm$^2$) at 77 kelvins in a one-tesla magnetic flux density. Such high current capability makes it a good candidate for various superconducting magnet applications.

Some efforts at adapting 1-2-3 to the task focus on forming it into wire (or tape). Doing so seems worthwhile because existing superconducting magnets cooled with liquid helium use wire. But ceramic HTS wire is brittle, and brittleness severely complicates the process of making a coil from fine HTS strands that can withstand the forces encountered. Moreover, making a ceramic HTS material sufficiently ductile and malleable to be formed into and used as wire can impair its current-carrying ability.

Trapping a magnetic field in a shell or cylinder of superconducting material would avoid wire and tape fabrication, but that approach involves certain other problems. To see why, recall that existing fabrication methods for trapping a magnetic field in a block of superconductive material proceed by using an electromagnet to apply a magnetic field to the material while the material is at a temperature above its critical temperature, $T_c$, (i.e., that at which it becomes superconducting). Next, the temperature of the material is lowered to less than $T_c$. Then, the electromagnet is de-energized and that results in currents flowing within the superconductor which at least partially maintain the applied magnetic field.

Those steps trap the magnetic field, but for HTS materials they can require an applied magnetic field having a magnetic flux density about three times as large as the desired flux density of the magnetic field to be trapped. So the process involves some difficulty and expense, especially to trap a magnetic flux density as large as one or two tesla.

SUMMARY OF THE INVENTION

This invention solves the problems outlined above by providing a superconducting magnet made from a block of superconducting material by an inventive method of trapping a magnetic field having a desired magnetic flux density using an applied magnetic field having a much smaller magnetic flux density. That is done by providing a low reluctance path for the applied magnetic field and then at least partially removing the low reluctance path once the magnetic field is trapped. Doing so can trap a magnetic field having a magnetic flux density as large as two tesla using an applied magnetic field having a magnetic flux density on the order of only 0.01 tesla.

Thus, the invention partakes of the lower cooling costs and favorable current-carrying ability of many HTS materials. It does so without incurring the cost and complexities of HTS wire or tape. In addition, the fabrication method avoids the difficulties and expense associated with larger applied fields.

Generally, a method of trapping a field in a block of superconductor material includes the steps of providing (i) a block of superconductor material defining a bore, (ii) a high permeability core within the bore that defines a low reluctance path through the bore, (iii) a high permeability external structure on the exterior of the block of material that defines a low reluctance path between opposite ends of the core, and (iv) an electromagnet configured to apply a magnetic field around the high permeability core. The method proceeds by energizing the electromagnet while the block of superconductor material is at a temperature above $T_c$ to produce an applied magnetic field around the high permeability core. Next, the block of superconductor material is cooled to less than $T_c$ in order to render it superconducting and the electromagnet is de-energized to result in a trapped magnetic field inside the bore. Then, the low reluctance path is at least partially removed in order to increase the magnetic flux density of the trapped magnetic field.

A superconducting magnet made by the foregoing process may include a block of material that is at least partially composed of a superconductor material having an anisotropic crystalline structure defining a series of parallel a-b planes. The block of material is in a superconductive state with superconducting currents flowing along the a-b planes. They sustain a magnetic field external to the block of material.

In addition, the block of material is so configured that the bore extends along a c-axis generally perpendicular to the a-b planes. That results in the superconducting currents encircling the bore as they flow along the a-b planes--as if flowing within a stack of washers. Those currents sustain a magnetic field directed axially through the bore, and so the superconducting magnet may be described as a permanent solenoidal magnet.

In one embodiment, the superconducting material is an HTS material (e.g., $YBa_2Cu_3O_7$) that has been melt-processed and machined using known non-destructive techniques so that it has a cylindrical shape and a wall adiabatically stable during trapping of the magnetic field. The wall thickness is chosen according to the relationship $B=2W\mu_o J_c(B)$ in order to sustain a desired maximum magnetic flux density, where B is magnetic flux density, W is wall thickness, $\mu_o$ is the permeability of vacuum, and $J_c(B)$ is the critical current density of the superconductor material in a direction perpendicular to B at a flux density equal to B.

The foregoing and other objects and features of the invention will become more apparent upon reading the following detailed description with reference to the accompanying illustrative drawings.

DESCRIPTION OF THE PREFERRED EMBODIMENTS

Figure 3:
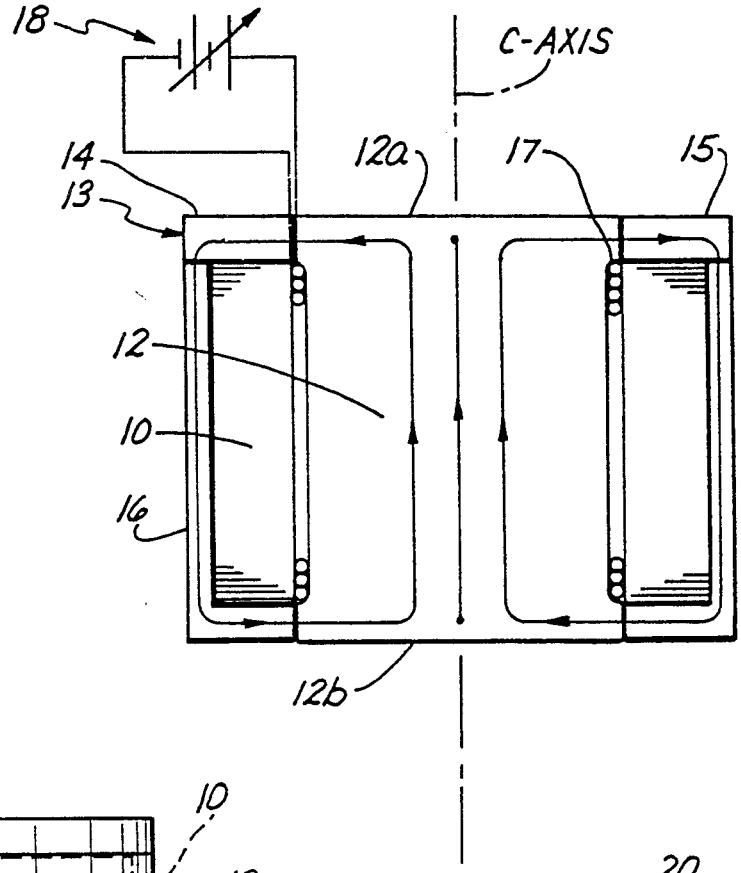
FIG. 3 is a diagrammatic representation of the step of producing the applied magnetic field.
Figure 4:
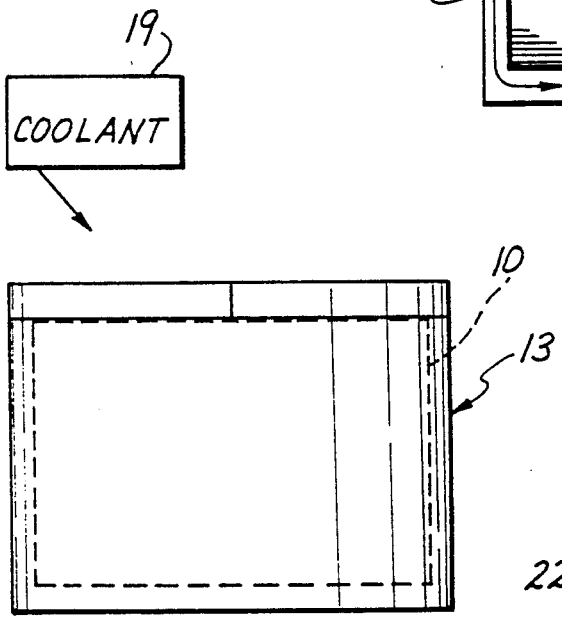
FIG. 4 shows the cooling step.
Figure 5:
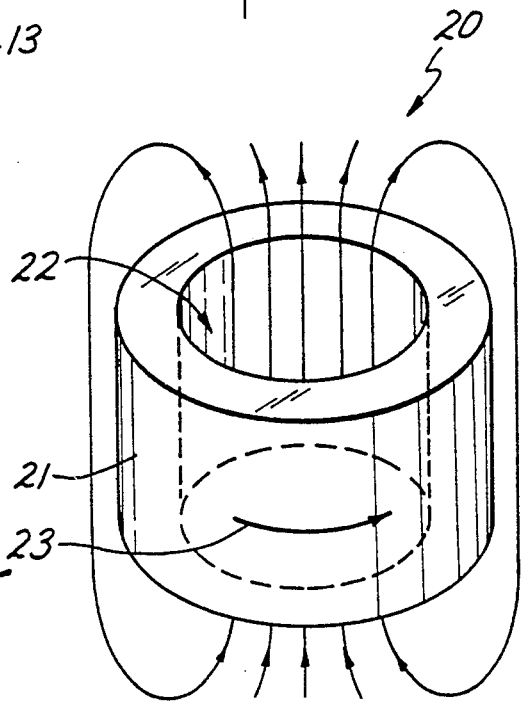
FIG. 5 is a isometric view of a superconducting magnet made by the illustrated process.

FIGS. 1–4 of the drawings diagram various aspects of the steps involved in fabricating a superconducting magnet according to the invention, while FIG. 5 illustrates the resulting superconducting magnet. Considering first the method of trapping the magnetic material, it may be described generally as including five steps. The first step includes providing certain elements and the remaining four steps include performing certain operations with those elements.

The first step includes providing (i) a block of superconductor material defining a bore, (ii) a high permeability core within the bore that defines a low reluctance path through the bore, (iii) a high permeability external structure on the exterior of the block of material that defines a low reluctance path between opposite ends of the core, and (iv) an electromagnet configured to apply a magnetic field around the high permeability core.

Figure 1:
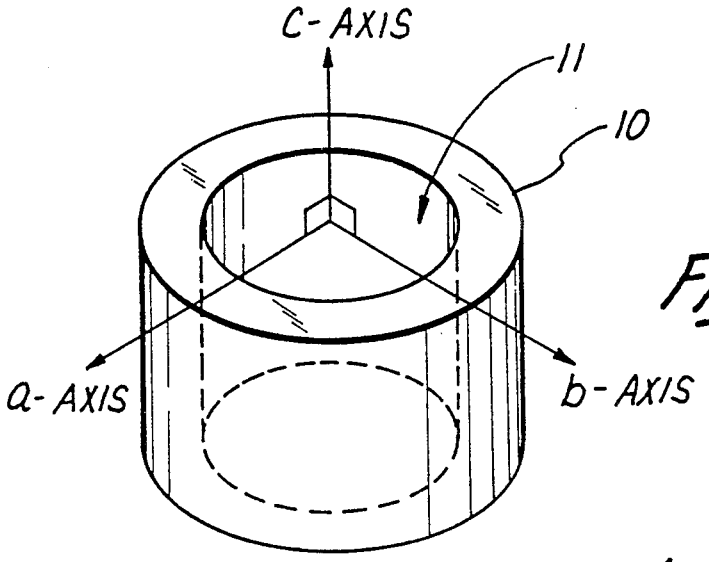
FIG. 1 of the drawings is an isometric view of the block of HTS material used to fabricate a superconducting magnet according to the invention.
Figure 2:
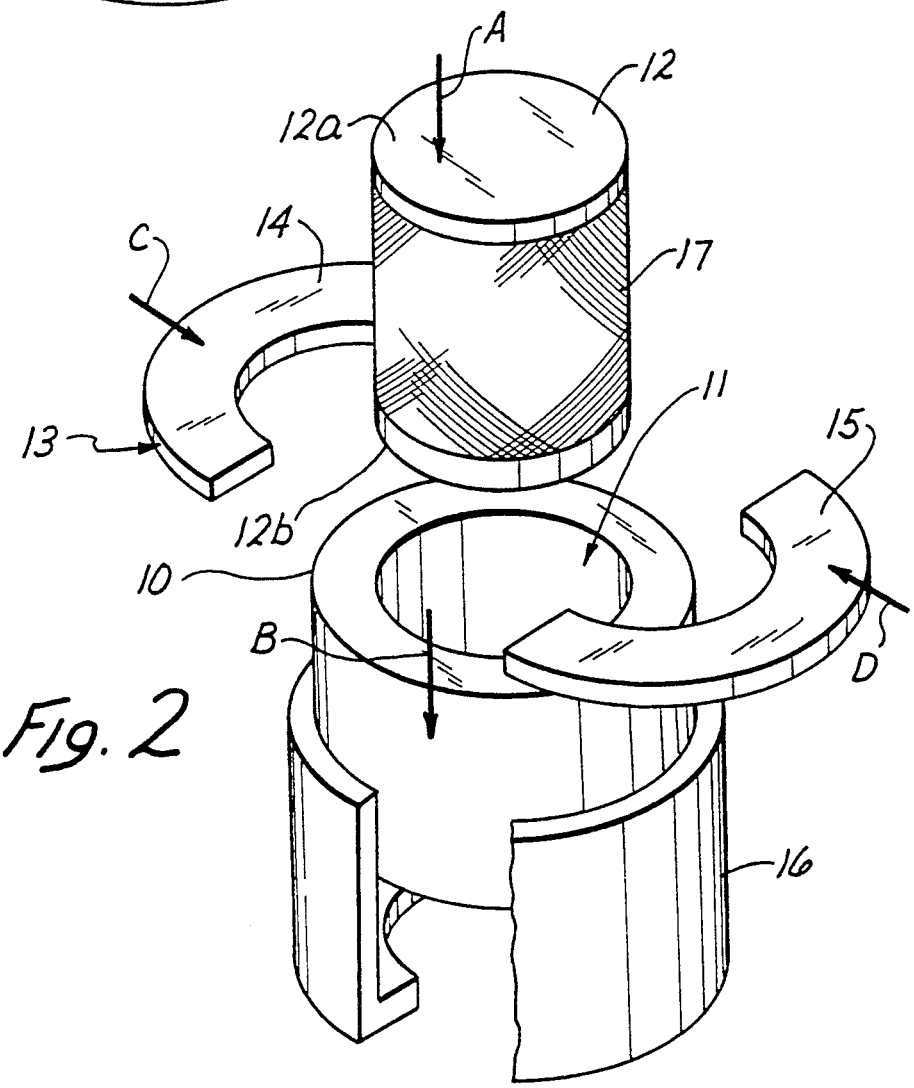
FIG. 2 is a diagrammatic representation of the field-trapping steps of providing the electromagnet and the high permeability path.

In the drawings, the block of superconducting material takes the form of a cylindrically shaped block 10 that defines a bore 11 (FIGS. 1–4). The high permeability core takes the form of an iron core 12 (FIGS. 2 and 3). The high permeability external structure includes three components that are designated generally by the reference numeral 13 and individual as first split ring section 14, second split ring section 15, and a tube 16 (FIGS. 2–4), and the electromagnet includes a solenoid 17 around the core 12 (FIGS. 2 and 3).

Although a block that is at least partially composed of any of various known superconducting materials may be used within the broader inventive concepts disclosed for trapping a magnetic field, the block 10 is composed of a ceramic HTS material, such as $YBa_2Cu_3O_7$. It has a known anisotropic crystalline structure characterized by sheets formed of copper and oxygen in parallel a-b planes that are parallel to a plane containing the a-axis and the b-axis of the a-b-c Cartesian coordinates illustrated in FIG. 1. Electric current flows best when channeled along the a-b planes and less easily in a perpendicular direction (i.e., the c-axis). So the block of material is configured with the bore 11 extending along the c-axis. As a result, superconducting currents flowing within the block encircle the bore.

Details of the low reluctance path are shown in FIG. 2. The core 12 is so configured that it fits within the bore 11 and that allows it to be inserted in the bore 11 of the block 10 as depicted by the arrow A. The core 12 is composed of a material having a permeability greater than one, preferably a material having a permeability substantially greater than one (e.g., iron). Thus, it provides a low reluctance path through the bore 11.

The individual components of the high permeability external structure 13 (i.e., the first and second split rings sections 14 and 15 and the tube 16) are also composed of a material having a permeability greater than one (preferably substantially greater than one), such as iron. The tube 16 is configured so that the block 10 fits within it and that allows the block 10 to be inserted into the tube 16 as depicted by an arrow B in FIG. 2. With the block 10 so inserted in the tube 16, the first and second split ring sections 14 and 15 are added as depicted by the arrows C and D. So assembled, the external structure 13 provides a low reluctance path between opposite ends **12*a* and 12*b* of the core 12 (FIGS. 2 and 3), and it combines with the core 12 to provide a substantially closed low reluctance path for an axial magnetic field directed along the c-axis as depicted by the magnetic lines of force illustrated in FIG. 3**.

The foregoing and subsequent discussions make it apparent that block 10 and the various components providing the low reluctance path may take any of various shapes and sizes within the broader inventive concepts disclosed. The block 10 may be small enough to be held in the hand, for example, or large enough to find use in a magnetic resonance imaging apparatus or even a superconducting synchrotron. The essential point is that there be provided a low reluctance path through the bore 11 and outside of the block 10 for the applied field produced by the electromagnet (i.e., the solenoid 17).

The solenoid 17 may also take any of various known forms and employ known techniques. When energized, it produces an applied field of predetermined strength (e.g., 0.01 tesla). A suitably configured power source 18 may be provided for that purpose (FIG. 3).

With the foregoing elements, the second step of the method of trapping a magnetic field proceeds by energizing the electromagnet while the block of superconductor material is at a temperature above $T_c$ to produce an applied magnetic field around the high permeability core. In other words, the solenoid 17 is energized with the power source 18 while the block 10 is at a temperature above $T_c$. For a block 10 composed of $YBa_2Cu_3O_7$, that means the block 10 is at a temperature above 94 kelvins, the critical temperature for that ceramic HTS material.

Next, the third step proceeds by cooling the block of superconductor material to less than $T_c$ in order to render the block of material superconducting. That is depicted in FIG. 4 by the coolant 19 which represents any suitable coolant and known cooling componentry configured according to known techniques to accomplish the cooling step. For the block 10, a coolant such as liquid nitrogen may be used, with the block 10 being immersed in it. For cooler temperatures, liquid helium may be needed. For materials having a significantly higher $T_c$, other coolants may suffice.

Once the block of superconductor material is cooled sufficiently to render it superconducting, the fourth step is performed. It proceeds by de-energizing the electromagnet (i.e., the solenoid 17). That leaves a trapped magnetic field inside the bore 11.

Then, the fifth step proceeds by at least partially removing the low reluctance path defined by the core 12 and the external structure 13. That results in the magnetic flux density of the trapped magnetic field increasing along the c-axis to values as high as the saturation flux density of the high permeability material used for the low reluctance path. For pure iron, fields slightly above two tesla can be reached.

That may be thought of as magnetic flux density amplification. It follows from the high permeability materials employed Recall in that regard that $B=\mu H$, where B is the magnetic flux density (referred to herein sometimes as magnetic field), $\mu$ is the permeability, and H is the applied magnetic field. The magnetic flux density B is what is conserved when the low reluctance path is removed. Without the low reluctance (high permeability) path, $\mu$ equals $\mu_o$, the permeability of vacuum. With the low reluctance path, $\mu$ equals = about $60{,}000\times10^{-7}$ webers/ampere-meter. So, $\mu/\mu_o$ equals about 4,700 (the "amplification factor").

All or only part of the external structure 13 may be removed. Removing only the core 12 and split ring sections 14 and 13, for example, leaves the tube 16 which may be used to confine the external magnetic field, as a support structure, or, perhaps, as part of cooling componentry that retains the block 10 at a temperature less than $T_c$.

It is necessary that the wall thickness (i.e., the radial thickness) of the block 10 be sufficient and the material properties good enough to sustain the resulting magnetic field. The maximum wall thickness is limited by a requirement that the superconductor remains adiabatically stable as the trapped magnetic field is produced. At 77 kelvins and in a magnetic field on the order of a few tesla, that stability condition limits the wall thickness for $YBa_2Cu_3O_7$ as presently fabricated to below about 0.5 cm.

From a critical state model one can calculate how large a magnetic field can be sustained by a certain wall thickness and a certain critical current density by the relationship $B=2W\mu_oJ_c(B)$, where B is magnetic flux density, w is wall thickness, $\mu_o$ is the permeability of vacuum, and $J_c(B)$ is the critical current density of the superconductor material in a direction perpendicular to B at an applied magnetic flux density equal to B.

Some melt-processed ceramic HTS materials, such as $YBa_2Cu_3O_7$, can sustain a critical current density, $J_c$, of about $10^4$ A/cm$^2$ in about a one tesla field. Materials with improved values of $J_c(B)$ enable permanent superconducting magnets with even higher magnetic fields. The crystal orientation of the HTS material is oriented to obtain maximum $J_c$ in a cylindrical geometry. The crystal a-b planes coincide with the planes where transport currents are trapped to obtain a magnetic field directed along the c-axis. A homogeneously layered crystal structure is obtained with known melt-processed techniques, and the final dimensions of the block 10 are produced using known non-destructive machining techniques.

A superconducting magnet 20 made by the foregoing process is shown in FIG. 5. It includes a block 21 that is similar in many respects to the block 10. It is cylindrically shaped and composed of a ceramic HTS material having an anisotropic crystalline structure characterized by sheets formed of copper and oxygen in parallel a-b planes. The block 21 is in a superconductive state enabling superconducting currents to flow within the superconducting material that sustain a magnetic field external to the block of material. The magnetic field is generally perpendicular to the a-b planes as depicted by the magnetic lines of force illustrated in FIG. 5.

Like the block 10, the block 21 defines a bore 22 extending along a c-axis that is generally perpendicular to the a-b planes. As the superconducting currents flow along the a-b planes, they encircle the bore 22 as depicted by an arrow 23 in FIG. 5. So, the magnet 20 may be called a superconducting solenoidal permanent magnet. Thus, the invention partakes of the lower cooling costs and favorable current-carrying ability of many HTS materials. It does so without incurring the cost and complexities of HTS wire or tape. In addition, the fabrication method avoids the difficulties and expense associated with larger applied fields, and it is adaptable to superconducting materials having even higher critical temperatures than the HTS materials described.

Although exemplary embodiments and procedures have been shown and described, many changes, modifications, and substitutions may be made by one having ordinary skill in the art without necessarily departing from the spirit and scope of the invention.

What is claimed is:

1. A method of trapping a field in a block of superconductor material, comprising:

providing (i) a block of superconductor material defining a bore, (ii) a high permeability core within the bore that defines a low reluctance path through the bore, (iii) a high permeability external structure on the exterior of the block of material that defines a low reluctance path between opposite ends of the core, and (iv) an electromagnet configured to apply a magnetic field around the high permeability core;

energizing the electromagnet while the block of superconductor material is at a temperature above $T_c$ to produce an applied magnetic field around the high permeability core;

cooling the block of superconductor material to less than $T_c$ in order to render the block of material superconducting;

de-energizing the electromagnet to result in a trapped magnetic field inside the bore; and at least partially removing the low reluctance path defined by the core and the external structure in order to increase the magnetic flux density of the trapped magnetic field.

2. A method as recited in claim 1, wherein the step of providing a block of material includes providing a block of material at least partially composed of an HTS material.

3. A method as recited in claim 1, wherein the step of providing a block of material includes providing a block of material at least partially composed of an HTS material having an anisotropic crystalline structure defining a series of parallel a-b planes, which block of material is so configured that the bore extends along a c-axis generally perpendicular to the a-b planes.

4. A method as recited in claim 1, wherein the step of providing a block of material includes providing a block of material at least partially composed of $YBa_2Cu_3O_7$.

5. A method as recited in claim 1, wherein the step of providing a block of material includes providing a block of material at least partially composed of a melt-processed HTS material.

6. A method as recited in claim 1, wherein the step of providing a block of material includes machining the block of material using non-destructive machining techniques.

* * * * *